US010124979B2

(12) United States Patent
Makita et al.

(10) Patent No.: US 10,124,979 B2
(45) Date of Patent: Nov. 13, 2018

(54) BINDING PROCESS DEVICE AND RECORDING-MEDIUM PROCESSING SYSTEM

(71) Applicant: FUJI XEROX CO., LTD., Tokyo (JP)

(72) Inventors: Takuya Makita, Kanagawa (JP); Hiroaki Awano, Kanagawa (JP); Yoshinori Nakano, Kanagawa (JP); Katsumi Harada, Kanagawa (JP); Kojiro Tsutsumi, Kanagawa (JP); Yasuhiro Kusumoto, Kanagawa (JP); Hiroshi Hagiwara, Kanagawa (JP); Junichi Hirota, Kanagawa (JP); Emiko Shiraishi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 61 days.

(21) Appl. No.: 15/236,616

(22) Filed: Aug. 15, 2016

(65) Prior Publication Data

US 2017/0275128 A1 Sep. 28, 2017

(30) Foreign Application Priority Data

Mar. 24, 2016 (JP) ..... 2016-060769

(51) Int. Cl.

| | |
|---|---|
| ***B65H 37/04*** | (2006.01) |
| ***B42C 1/12*** | (2006.01) |
| ***G03G 15/00*** | (2006.01) |
| ***B42B 5/00*** | (2006.01) |

(52) U.S. Cl.

CPC ..... *B65H 37/04* (2013.01); *B42B 5/00* (2013.01); *B42C 1/12* (2013.01); *G03G 15/6541* (2013.01); *G03G 15/6544* (2013.01); *B65H 2801/48* (2013.01); *G03G 2215/00822* (2013.01); *G03G 2215/0132* (2013.01)

(58) Field of Classification Search

CPC ... B65H 37/04; B42C 1/12; B31F 1/07; B31F 5/02; B31F 2201/0712; B42F 3/00; B41F 19/02; G03G 15/6544; G03G 2215/00852

USPC ..... 270/58.07, 58.08, 58.09

See application file for complete search history.

(56) References Cited

U.S. PATENT DOCUMENTS

| | | | | |
|---|---|---|---|---|
| 8,297,610 | B2 * | 10/2012 | Shiraishi | B65H 37/04 270/58.08 |
| 9,321,293 | B2 * | 4/2016 | Obuchi | B42C 5/00 |
| 2013/0214471 | A1 * | 8/2013 | Yabe | B65H 39/00 270/1.01 |
| 2014/0161565 | A1 * | 6/2014 | Obuchi | B42C 5/00 412/33 |

(Continued)

FOREIGN PATENT DOCUMENTS

JP 2015-168131 A 9/2015

*Primary Examiner* — Leslie A Nicholson, III
(74) *Attorney, Agent, or Firm* — Sughrue Mion, PLLC

(57) ABSTRACT

A binding process device includes an advancing member and a binding process unit. The advancing member advances toward a corner of a recording-medium bundle having multiple edges and having the corner at an intersection position where the edges intersect. The binding process unit performs a binding process on the recording-medium bundle by causing the advancing member to advance toward the corner and is capable of performing the binding process at a first position and at a second position located closer to the intersection position than the first position.

4 Claims, 12 Drawing Sheets

(56) References Cited

U.S. PATENT DOCUMENTS

| | | | | |
|---|---|---|---|---|
| 2016/0060069 | A1* | 3/2016 | Miyahara ..... | G03G 15/6541<br>358/3.28 |
| 2016/0159605 | A1* | 6/2016 | Miyahara ..... | G03G 15/6544<br>270/1.01 |

* cited by examiner

BINDING PROCESS DEVICE AND RECORDING-MEDIUM PROCESSING SYSTEM

CROSS-REFERENCE TO RELATED APPLICATIONS

This application is based on and claims priority under 35 USC 119 from Japanese Patent Application No. 2016-060769 filed Mar. 24, 2016.

BACKGROUND

Technical Field

The present invention relates to binding process devices and recording-medium processing systems.

SUMMARY

According to an aspect of the invention, there is provided a binding process device including an advancing member and a binding process unit. The advancing member advances toward a corner of a recording-medium bundle having multiple edges and having the corner at an intersection position where the edges intersect. The binding process unit performs a binding process on the recording-medium bundle by causing the advancing member to advance toward the corner and is capable of performing the binding process at a first position and at a second position located closer to the intersection position than the first position.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below with reference to the appended drawings.

Figure 1:
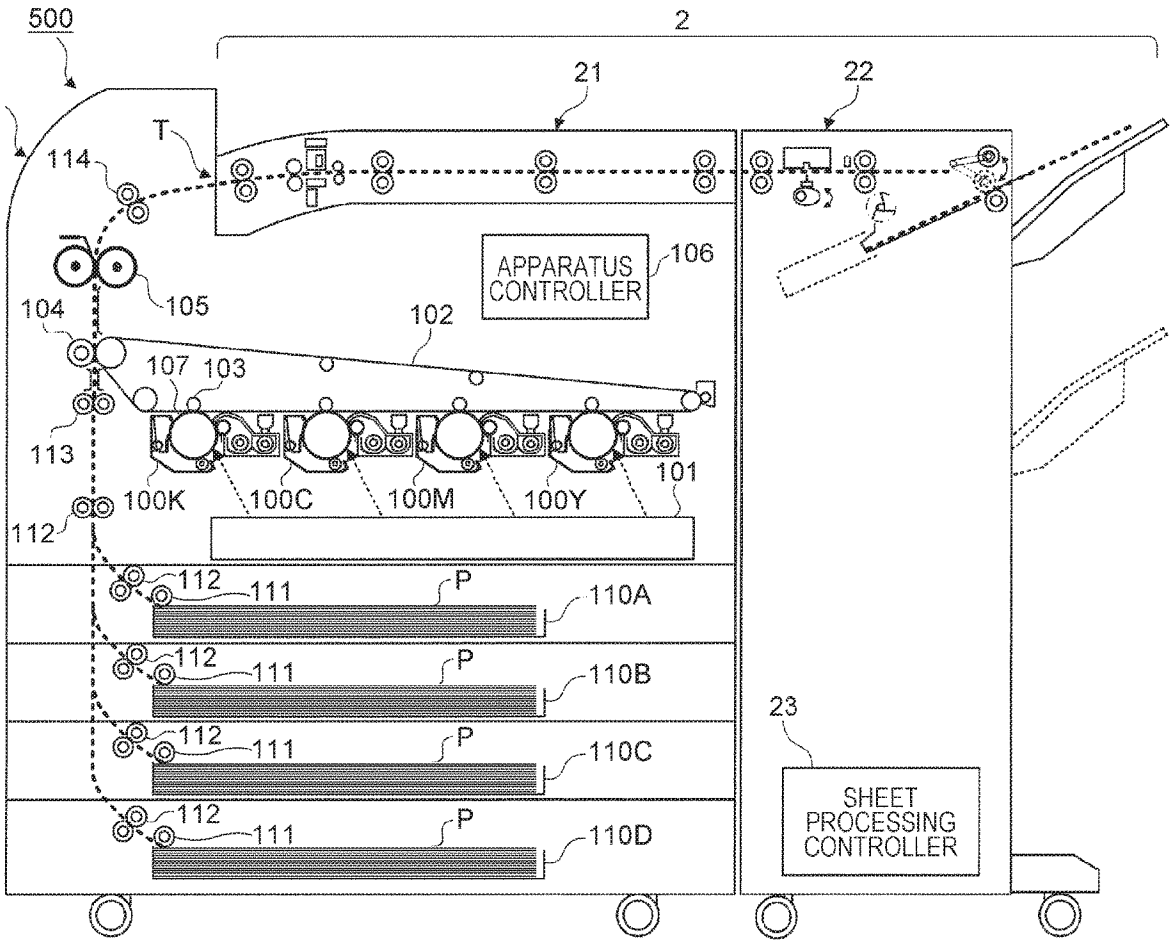
FIG. 1 illustrates the configuration of a recording-medium processing system.

FIG. 1 illustrates the configuration of a recording-medium processing system 500 according to this exemplary embodiment.

The recording-medium processing system 500 according to this exemplary embodiment is provided with an image forming apparatus 1 that forms an image onto a recording medium, such as a sheet P, by, for example, electrophotography and a post-processing apparatus 2 that performs post-processing on multiple sheets P having images formed thereon by the image forming apparatus 1.

The image forming apparatus 1 is of a so-called tandem type and includes four image forming units 100Y, 100M, 100C, and 100K (which may also be collectively referred to as "image forming units 100") that form images based on image data of respective colors. The image forming apparatus 1 is provided with a laser exposure device 101 that radiates exposure light onto photoconductor drums 107 provided in the individual image forming units 100 so as to form electrostatic latent images on the surfaces of the photoconductor drums 107.

Furthermore, the image forming apparatus 1 is provided with an intermediate transfer belt 102 onto which toner images of the respective colors formed at the image forming units 100 are superposed and transferred, and is also provided with first-transfer rollers 103 that sequentially transfer (first-transfer) the toner images formed at the image forming units 100 onto the intermediate transfer belt 102. Moreover, the image forming apparatus 1 is provided with a second-transfer roller 104 that collectively transfers (second-transfers) the toner images transferred on the intermediate transfer belt 102 onto a sheet P, a fixing device 105 that fixes the second-transferred toner images onto the sheet P, and an apparatus controller 106 that controls the operation of the image forming apparatus 1.

In each image forming unit 100, the photoconductor drum 107 is electrostatically charged, and an electrostatic latent image is formed on the photoconductor drum 107. The electrostatic latent image is developed so that a toner image of the corresponding color is formed on the surface of the photoconductor drum 107.

The toner images formed on the surfaces of the individual photoconductor drums 107 are sequentially transferred onto the intermediate transfer belt 102 by the first-transfer rollers 103. Then, as the intermediate transfer belt 102 moves, the toner images are transported to a position where the second-transfer roller 104 is disposed.

The image forming apparatus 1 has sheet accommodation sections 110A to 110D that accommodate therein sheets P of different sizes and different types. For example, a sheet P is picked up from the sheet accommodation section 110A by a pickup roller 111, and this sheet P is transported to a registration roller 113 by a transport roller 112.

Then, in accordance with a timing at which the toner images on the intermediate transfer belt 102 are transported to the second-transfer roller 104, the sheet P is fed from the registration roller 113 toward an opposing section (i.e., a second-transfer section) where the second-transfer roller 104 and the intermediate transfer belt 102 face each other.

The toner images on the intermediate transfer belt 102 are then collectively electrostatically transferred (second-transferred) onto the sheet P due to the effect of a transfer electric field generated by the second-transfer roller 104.

Subsequently, the sheet P having the toner images transferred thereon is separated from the intermediate transfer belt 102 and is transported toward the fixing device 105. The fixing device 105 performs a fixing process by using heat and pressure so as to fix the toner images onto the sheet P, whereby an image is formed on the sheet P.

Then, the sheet P having the image formed thereon is output from a sheet output section T of the image forming apparatus 1 by a transport roller 114 and is fed to the post-processing apparatus 2 connected to the image forming apparatus 1.

The post-processing apparatus 2 is disposed downstream of the sheet output section T of the image forming apparatus 1 and performs post-processing, such as a hole-punching process and a binding process, on the sheet P having the image formed thereon.

Figure 2:
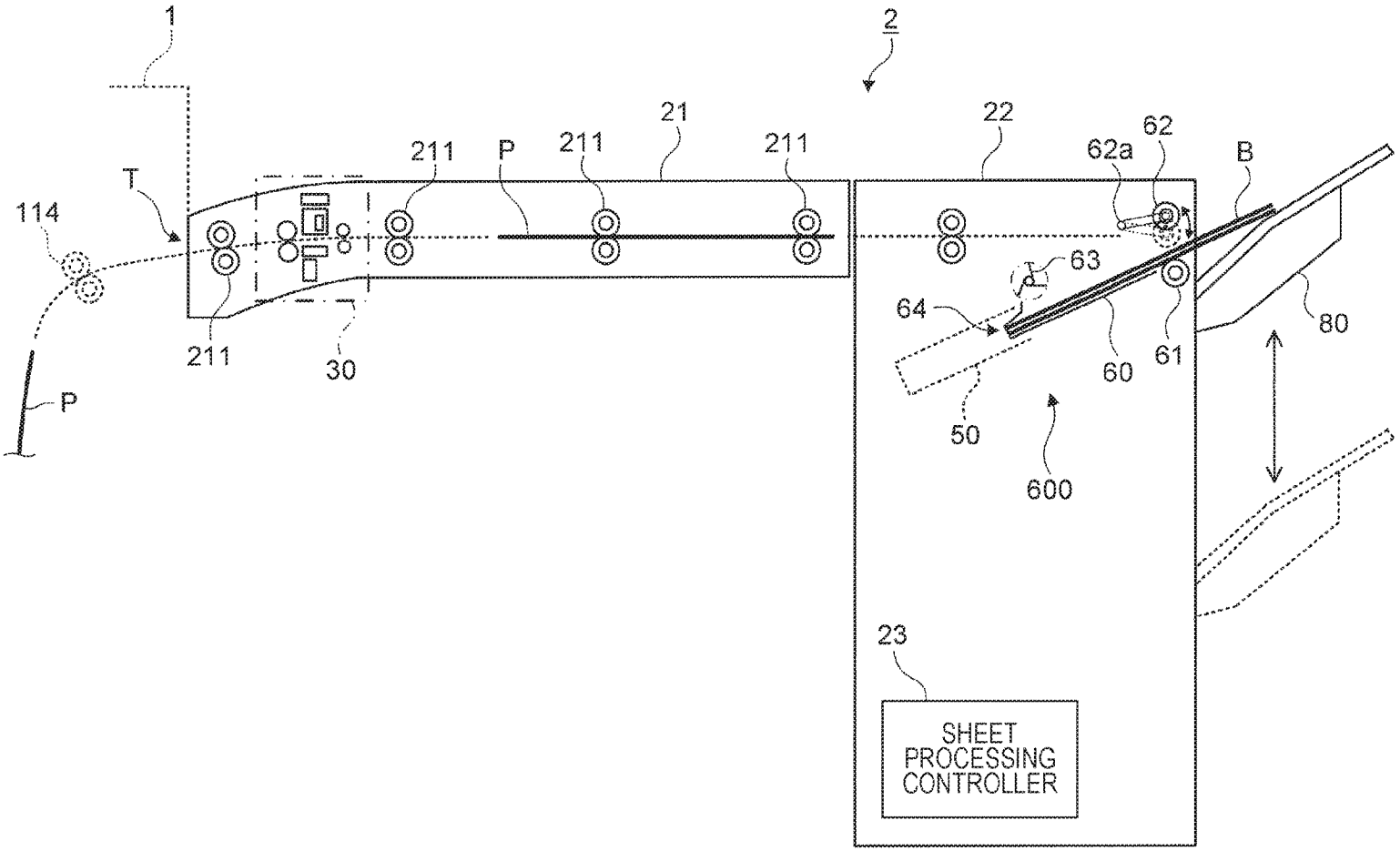
FIG. 2 illustrates the configuration of a post-processing apparatus.

FIG. 2 illustrates the configuration of the post-processing apparatus 2.

As shown in FIG. 2, the post-processing apparatus 2 includes a transport unit 21 connected to the sheet output section T of the image forming apparatus 1 and also includes a finisher unit 22 that performs a predetermined process on the sheet P transported by the transport unit 21.

The post-processing apparatus 2 also includes a sheet processing controller 23 that controls each functional unit of the post-processing apparatus 2. The sheet processing controller 23 is connected to the apparatus controller 106 (see FIG. 1) by a signal line (not shown) and exchanges, for example, control signals therewith.

Furthermore, the post-processing apparatus 2 includes a stacker section 80 on which sheets P (i.e., a sheet bundle B) that have undergone a process performed by the post-processing apparatus 2 are stacked.

Although the sheet processing controller 23 is provided within a housing of the finisher unit 22 in the post-processing apparatus 2 according to this exemplary embodiment, the sheet processing controller 23 may alternatively be provided within a housing of the image forming apparatus 1 (see FIG. 1). Furthermore, the apparatus controller 106 of the image forming apparatus 1 may alternatively have the control function of the sheet processing controller 23.

As shown in FIG. 2, the transport unit 21 of the post-processing apparatus 2 is provided with a punching functional unit 30 that performs, for example, a two-hole or four-hole punching process.

Moreover, the transport unit 21 is provided with multiple transport rollers 211 that transport the sheet P having the image formed thereon in the image forming apparatus 1 toward the finisher unit 22.

The finisher unit 22 is provided with a binding process device 600 that performs a binding process on a sheet bundle B as an example of a recording-medium bundle. Specifically, the binding process device 600 according to this exemplary embodiment binds a sheet bundle B together without using staples.

The binding process device 600 is provided with a sheet accumulation section 60 that supports sheets P from below and accumulates a predetermined number of sheets P so as to form a sheet bundle B. The binding process device 600 is also provided with a binding unit 50 that binds the sheet bundle B together.

In this exemplary embodiment, the binding process performed on the sheet bundle B involves pressing advancing members (to be described later) provided in the binding unit 50 against the sheet bundle B from opposite faces of the sheet bundle B so as to bring the sheets P constituting the sheet bundle B into pressure contact with each other (i.e., to cause the fibers constituting the sheets P to entwine).

Furthermore, the binding process device 600 is provided with a transport roller 61 and a movable roller 62. The transport roller 61 rotates clockwise in FIG. 2 and delivers the sheet bundle B on the sheet accumulation section 60 toward the stacker section 80.

The movable roller 62 is provided in a movable manner about a rotation shaft 62*a* and is located at a receded position from the transport roller 61 when sheets P are to be accumulated on the sheet accumulation section 60. When delivering the created sheet bundle B toward the stacker section 80, the movable roller 62 is pressed against the sheet bundle B on the sheet accumulation section 60.

A process performed in the post-processing apparatus 2 will now be described.

In this exemplary embodiment, a command signal indicating that a process is to be executed on a sheet P is output from the apparatus controller 106 to the sheet processing controller 23. The sheet processing controller 23 receives this command signal so that the post-processing apparatus 2 executes the process on the sheet P.

In the process performed in the post-processing apparatus 2 (see FIG. 2), the sheet P having the image formed thereon in the image forming apparatus 1 is first fed to the transport unit 21 of the post-processing apparatus 2. In the transport unit 21, the punching functional unit 30 performs a hole-punching process in accordance with the command signal from the sheet processing controller 23, and the transport rollers 211 subsequently transport the sheet P toward the finisher unit 22.

If there is no hole-punching command from the sheet processing controller 23, the sheet P is delivered to the finisher unit 22 without undergoing the hole-punching process by the punching functional unit 30.

The sheet P delivered to the finisher unit 22 is transported to the sheet accumulation section 60 provided in the binding process device 600. Then, the sheet P slides on the sheet accumulation section 60 in accordance with an inclination angle given to the sheet accumulation section 60 so as to abut on sheet regulation sections 64 provided at an end of the sheet accumulation section 60.

Thus, the sheet P stops moving. In this exemplary embodiment, the sheet P abuts on the sheet regulation sections 64 so that a sheet bundle B having sheets P with aligned trailing edges is created on the sheet accumulation section 60. In this exemplary embodiment, a rotating paddle 63 that moves the sheet P toward the sheet regulation sections 64 is further provided.

Figure 3:
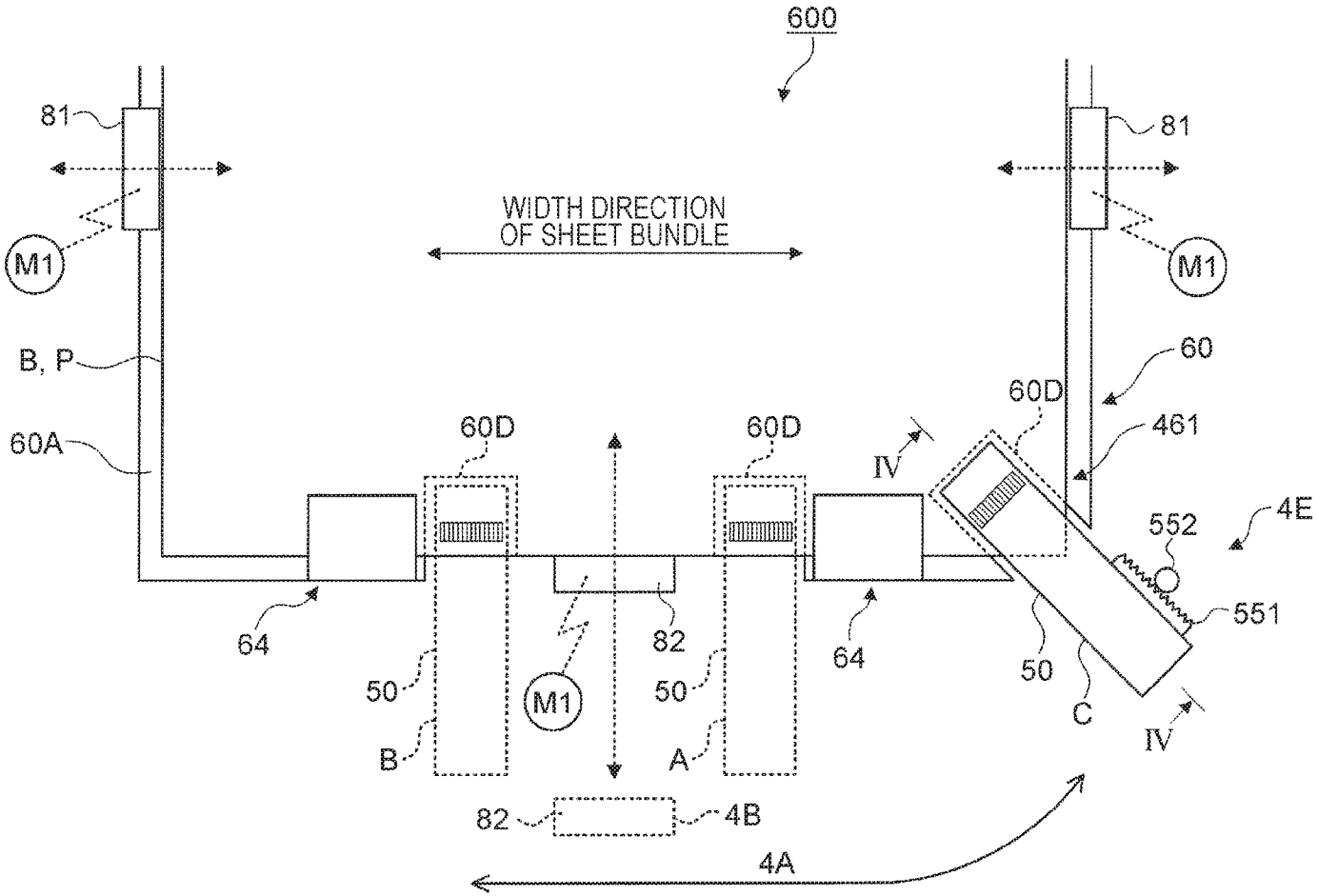
FIG. 3 illustrates a binding process device, as viewed from above.

FIG. 3 illustrates the binding process device 600, as viewed from above.

The opposite widthwise edges of the sheet accumulation section 60 are provided with first movable members 81.

The first movable members 81 are pressed against the edges of sheets P constituting the sheet bundle B so as to positionally align the edges of the sheets P constituting the sheet bundle B. Moreover, the first movable members 81 move in the width direction of the sheet bundle B so as to move the sheet bundle B in the width direction of the sheet bundle B.

In detail, in this exemplary embodiment, when sheets P are to be accumulated on the sheet accumulation section 60, the first movable members 81 are pressed against the edges of the sheets P so as to positionally align the edges of the sheets P.

If the binding position of the sheet bundle B is to be changed, which will be described later, the first movable members 81 press against the sheet bundle B so as to move the sheet bundle B in the width direction of the sheet bundle B.

Furthermore, the binding process device 600 according to this exemplary embodiment is provided with a second movable member 82.

The second movable member 82 moves in the vertical direction in FIG. 3 so as to move the sheet bundle B in a direction orthogonal to the width direction of the sheet bundle B.

Moreover, movement motors M1 for moving the first movable members 81 and the second movable member 82 are provided in this exemplary embodiment.

As indicated by an arrow 4A in FIG. 3, the binding unit 50 is movable in the width direction of the sheets P. For example, the binding unit 50 performs a binding process (i.e., a two-point binding process) at two points (position A and position B) located at different positions in the width direction of the sheet bundle B.

Moreover, the binding unit 50 moves to position C in FIG. 3 so as to perform a binding process (i.e., a one-point binding process) on a corner of the sheet bundle B.

The binding unit 50 moves linearly between position A and position B, whereas the binding unit 50 moves while rotating by, for example, 45° between position A and position C.

In this exemplary embodiment, the binding unit 50 performs the binding process in an area where the sheet regulation sections 64 and the second movable member 82 are not provided.

In detail, as shown in FIG. 3, the binding unit 50 performs the binding process between the left sheet regulation section 64 and the second movable member 82 as well as between the right sheet regulation section 64 and the second movable member 82. Moreover, in this exemplary embodiment, the binding unit 50 performs the binding process in an area adjacent to the right sheet regulation section 64 (i.e., a corner of the sheet bundle B).

As shown in FIG. 3, a base plate 60A is provided with three cutouts 60D. Thus, interference between the sheet accumulation section 60 and the binding unit 50 may be avoided.

Furthermore, in this exemplary embodiment, when the binding unit 50 is to move, the second movable member 82 moves to a position indicated by a reference sign 4B in FIG. 3. Thus, interference between the binding unit 50 and the second movable member 82 may be avoided.

Figure 4A:
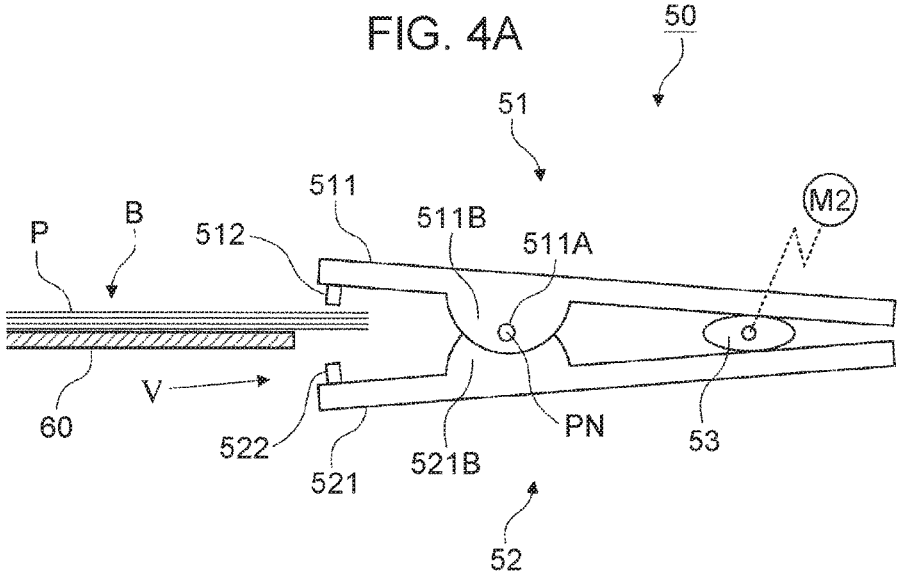
FIGS. 4A and 4B are cross-sectional views taken along line IV-IV in FIG. 3.
Figure 4B:
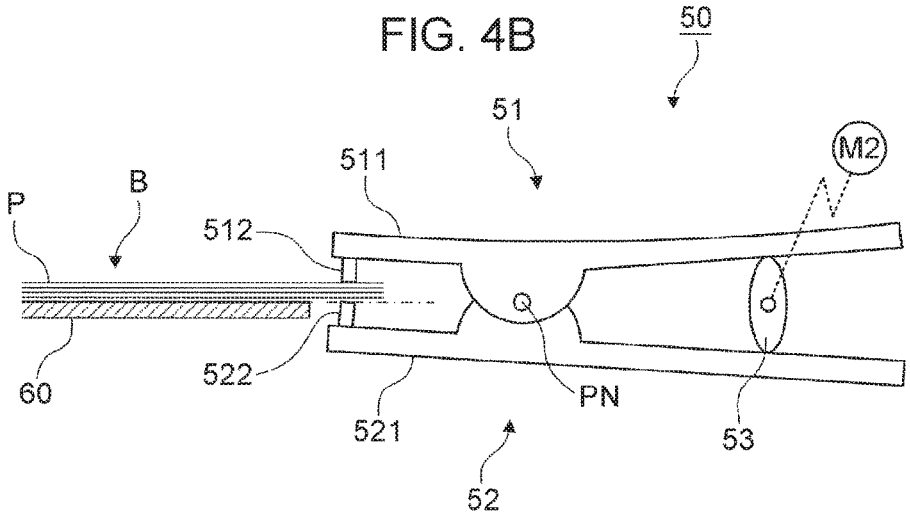

FIGS. 4A and 4B are cross-sectional views taken along line IV-IV in FIG. 3.

As shown in FIG. 4A, the binding unit 50 includes a first driver 51 extending in the left-right direction in FIG. 4A, a second driver 52 similarly extending in the left-right direction in FIG. 4A, an ellipsoidal cam 53 disposed between the first driver 51 and the second driver 52, and a cam motor M2 that drives the cam 53.

The first driver 51 is provided with a driving piece 511. The driving piece 511 is plate-shaped and has a first end at the sheet bundle B side and a second end opposite from the first end.

In this exemplary embodiment, a first advancing member 512 is attached to the first end of the driving piece 511. The first advancing member 512 advances toward the sheet bundle B from one face of the sheet bundle B so as to press against this sheet bundle B. Furthermore, the driving piece 511 is provided with a protrusion 511B that protrudes toward the second driver 52. The protrusion 511B has a through-hole 511A.

As shown in FIG. 4A, the second driver 52 includes a driving piece 521.

The driving piece 521 is plate-shaped and has a first end at the sheet bundle B side and a second end opposite from the first end. In this exemplary embodiment, a second advancing member 522 is attached to the first end of the driving piece 521. The second advancing member 522 advances toward the other face of the sheet bundle B so as to press against the sheet bundle B.

The driving piece 521 is also provided with a protrusion 521B that protrudes toward the first driver 51. The protrusion 521B has a through-hole (which is not shown but is provided at a position behind the through-hole 511A of the first driver 51).

Furthermore, in this exemplary embodiment, a pin PN extends through the through-hole 511A provided in the first driver 51 and the through-hole (not shown) provided in the second driver 52. In this exemplary embodiment, the driving piece 511 and the driving piece 521 rotate about the pin PN.

Moreover, in this exemplary embodiment, the first advancing member 512 and the second advancing member 522 are provided at the sheet bundle B side relative to the pin PN, and the cam 53 is provided at the side opposite from the side provided with the sheet bundle B with the pin PN interposed therebetween.

As shown in FIG. 4B, when the cam 53 is rotated by the cam motor M2 in this exemplary embodiment, the first advancing member 512 and the second advancing member 522 move toward each other so that the sheet bundle B is nipped by the first advancing member 512 and the second advancing member 522, whereby pressure is applied to the sheet bundle B. This causes the fibers of the sheets P constituting the sheet bundle B to entwine so that adjacent sheets P are joined to each other, whereby a sheet bundle B having undergone a binding process is created.

Figure 5:
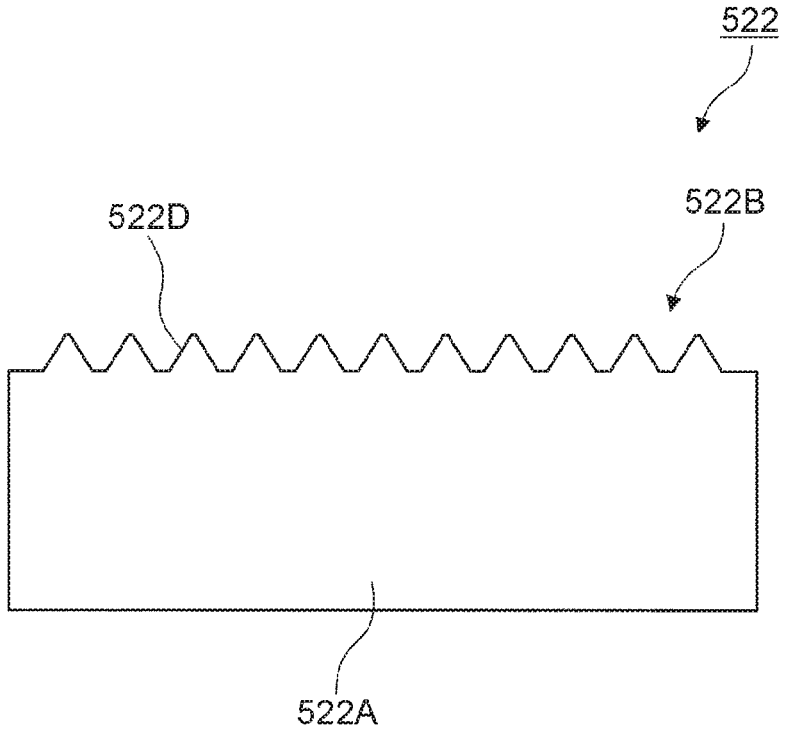
FIG. 5 illustrates a second advancing member, as viewed in the direction of an arrow V in FIG. 4A.

FIG. 5 illustrates the second advancing member 522, as viewed in the direction of an arrow V in FIG. 4A. Although the second advancing member 522 is illustrated as an example in FIG. 5, the first advancing member 512 and the second advancing member 522 have identical configurations except for the fact that they have vertically inverted configurations.

The second advancing member 522 has a rectangular prismatic base 522A. An upper surface 522B of this base 522A is provided with projections and depressions. More specifically, the upper surface 522B of the base 522A is provided with multiple projections 522D. The projections 522D are arranged in the left-right direction in FIG. 5 (i.e., in the longitudinal direction of the second advancing member 522).

Figure 6:
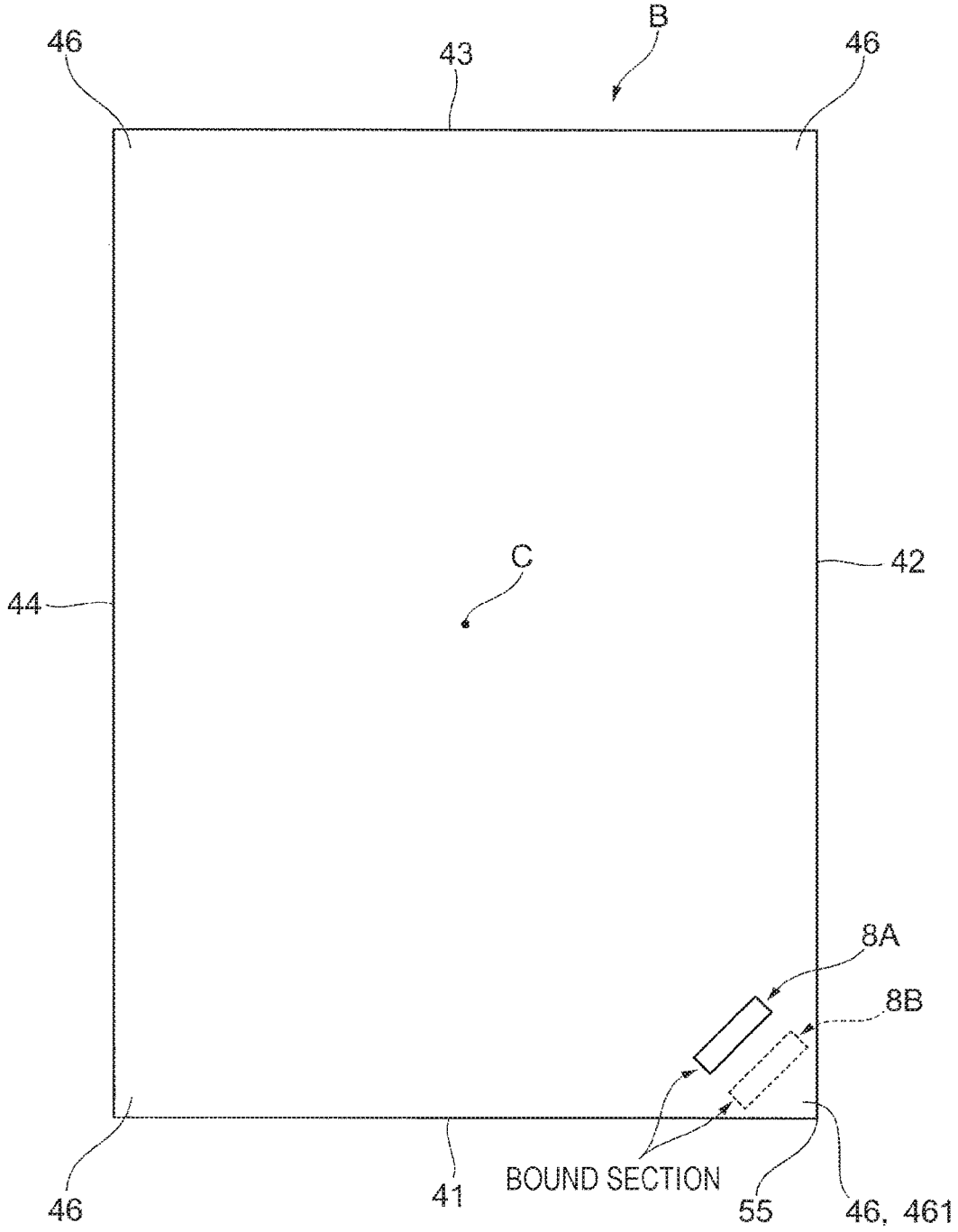
FIG. 6 illustrates a binding process performed on a corner of a sheet bundle.

FIG. 6 illustrates a binding process performed on a corner of the sheet bundle B.

This binding process performed on the corner of the sheet bundle B involves causing the first advancing member 512 and the second advancing member 522 to advance toward this corner.

In this exemplary embodiment, this corner binding process may be performed at either a first binding position 8A or a second binding position 8B, which is located closer to an edge intersection position than the first binding position 8A.

In detail, the sheet bundle B according to this exemplary embodiment has a rectangular shape when viewed from the front and has first to fourth edges 41 to 44.

Furthermore, the sheet bundle B according to this exemplary embodiment has four corners 46 at the position where the first edge 41 and the second edge 42 intersect, the position where the second edge 42 and the third edge 43 intersect, the position where the third edge 43 and the fourth edge 44 intersect, and the position where the fourth edge 44 and the first edge 41 intersect, respectively.

In this exemplary embodiment, the binding process is performed on the corner 46 (which will be referred to as "first corner 461" hereinafter) located at the intersection position where the first edge 41 and the second edge 42 intersect (which will be referred to as "first intersection position 55" hereinafter). This binding process for the first corner 461 may be performed at either the first binding position 8A, which is closer toward a center C of the sheet bundle B, or the second binding position 8B, which is closer to the first intersection position 55 than the first binding position 8A.

More specifically, in this exemplary embodiment, if the number of sheets P constituting the sheet bundle B is smaller than or equal to a predetermined value, the binding process is performed at the first binding position 8A. If the number of sheets P constituting the sheet bundle B exceeds the predetermined value, the binding process is performed at the second binding position 8B.

Figure 7:
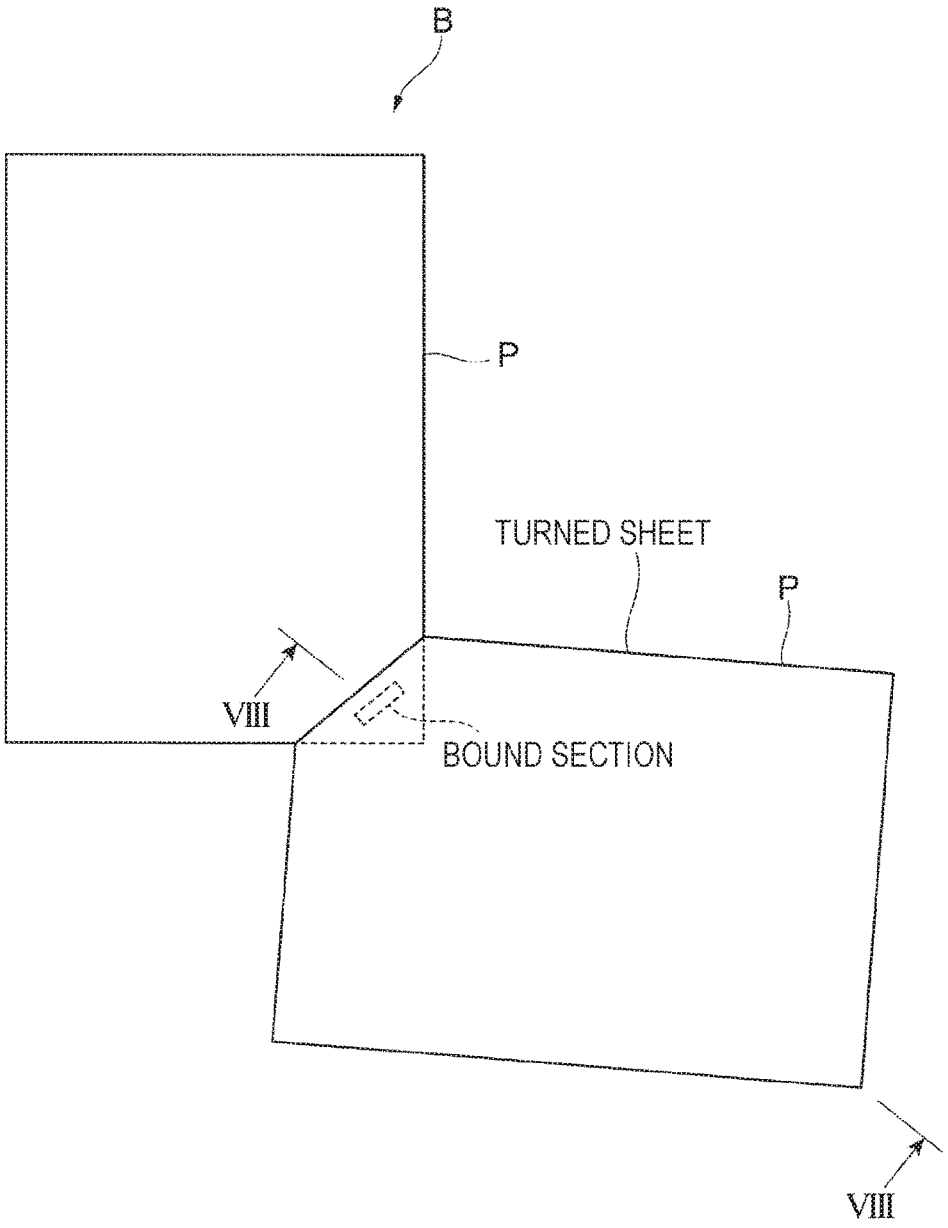
FIG. 7 illustrates a state where one or more of sheets constituting the sheet bundle are turned over.
Figure 8A:
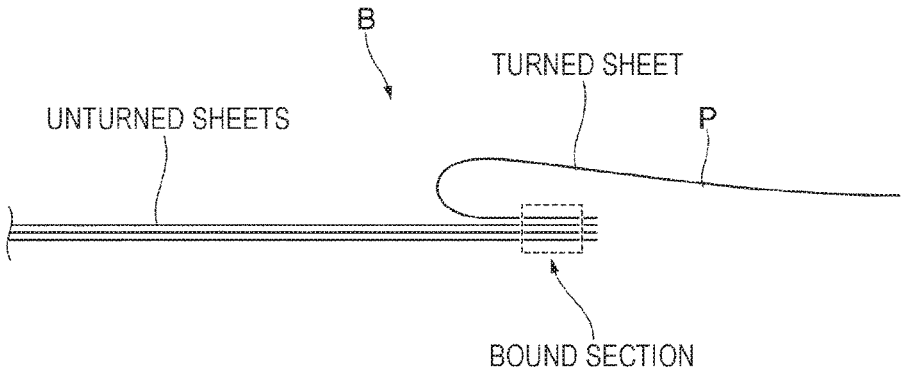
FIGS. 8A and 8B are cross-sectional views of the sheet bundle, taken along line VIII-VIII in FIG. 7.
Figure 8B:
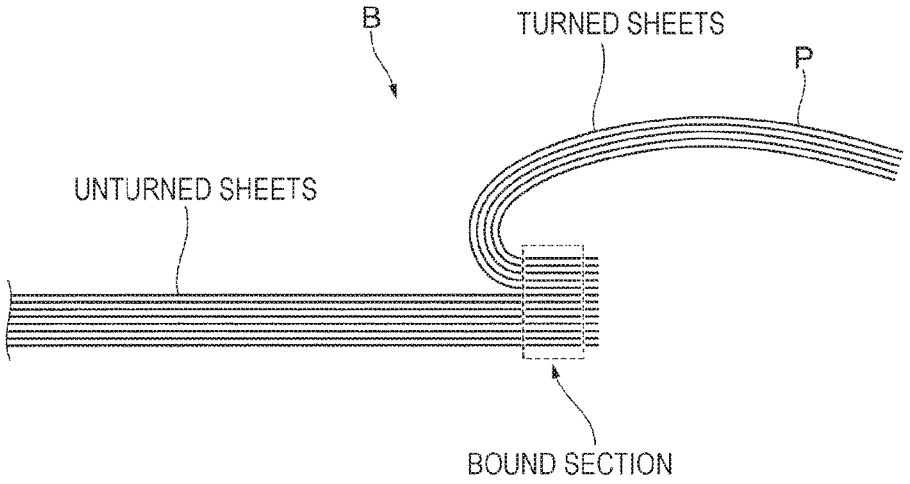

FIG. 7 illustrates a state where one or more of the sheets P constituting the sheet bundle B are turned over. FIGS. 8A and 8B are cross-sectional views of the sheet bundle B, taken along line VIII-VIII in FIG. 7.

The load acting on the bound section of the sheet bundle B (i.e., load that may cause the bound section to be unbound) varies depending on the number of sheets P constituting the sheet bundle B.

As shown in FIG. 8A, if the number of sheets P constituting the sheet bundle B is small, a sheet P turned over has low stiffness, and this sheet P bends easily. In this case, the turned sheet P readily conforms to the unturned sheets P at the bound section, so that the load acting on the bound section is small.

In contrast, as shown in FIG. 8B, if the number of sheets P constituting the sheet bundle B is large, sheets P turned over have high stiffness, and these turned sheets P do not bend easily.

In this case, the turned sheets P have a certain angle relative to the unturned sheets P at the bound section, so that the load that may cause the bound section to be unbound is likely to act on the bound section.

When the number of sheets P constituting the sheet bundle B is large in this manner, the load acting on the bound section increases (i.e., the bound section is likely to become unbound easily). Therefore, in this exemplary embodiment, if the number of sheets P constituting the sheet bundle B is large, the binding process is performed at the binding position where the load acting on the bound section is smaller. In detail, the binding process is performed at the second binding position 8B that is located closer to the first intersection position 55 (see FIG. 6).

In contrast, if the load acting on the bound section is small due to a small number of sheets P constituting the sheet bundle B, the binding process is performed at the first binding position 8A.

Figure 9A:
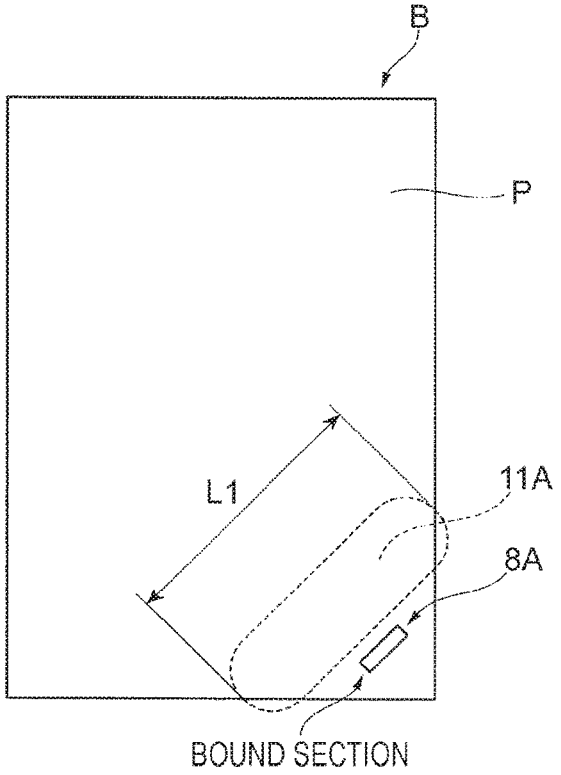
FIGS. 9A and 9B illustrate the states of the sheet bundle after undergoing binding processes at a first binding position and a second binding position, respectively.
Figure 9B:
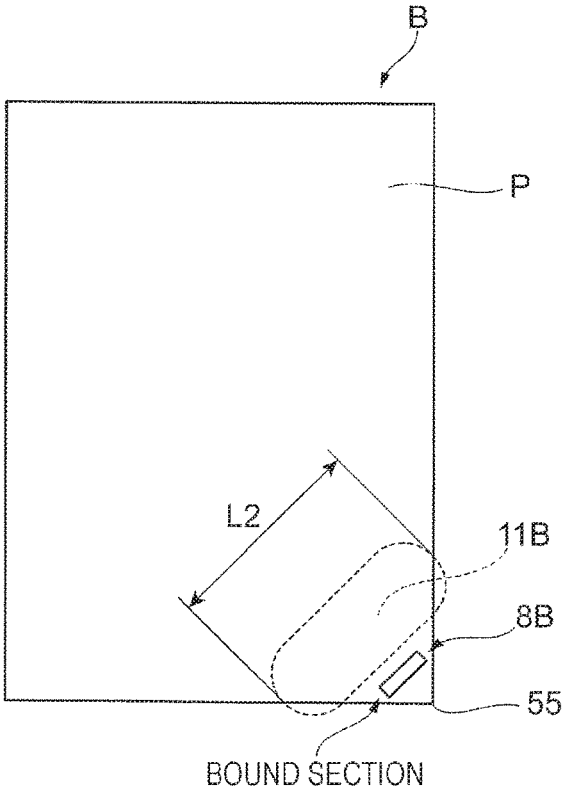

FIGS. 9A and 9B illustrate the states of the sheet bundle B after undergoing binding processes at the first binding position 8A and the second binding position 8B, respectively.

Specifically, FIG. 9A illustrates the state of the sheet bundle B having a large number of sheets P after undergoing the binding process performed at the first binding position 8A. FIG. 9B illustrates the state of the sheet bundle B having a large number of sheets P after undergoing the binding process performed at the second binding position 8B.

If sheets P in the sheet bundle B shown in FIG. 9A (i.e., the sheet bundle B bound at the first binding position 8A) are turned over, the sheets P bend in an area 11A located immediately in front of the bound section. In this case, the area 11A has a large dimension (indicated by a reference sign L1) in the longitudinal direction thereof, thus making it difficult for the sheets P to bend. As described above, the turned sheets P in this case are likely to have a certain angle relative to the unturned sheets P, so that the load that may cause the bound section to be unbound is likely to act on the bound section.

In contrast, if sheets P in the sheet bundle B shown in FIG. 9B (i.e., the sheet bundle B bound at the second binding position 8B located closer to the first intersection position 55) are turned over, an area 11B located immediately in front of the bound section has a small dimension (indicated by a reference sign L2) in the longitudinal direction thereof. In this case, the sheets P bend easily, so that the turned sheets P readily conform to the unturned sheets P at the bound section. Thus, the load acting on the bound section becomes smaller.

Accordingly, in this exemplary embodiment, if the number of sheets P constituting the sheet bundle B exceeds the predetermined value, the binding position is changed to a position closer to the first intersection position 55. Thus, the bound section becomes less likely to be unbound.

If the number of sheets P constituting the sheet bundle B is small, the bound section is formed at a position closer toward the center C (see FIG. 6) of the sheet bundle B. In this case, the bound section may have a better cosmetic appearance, as compared with a case where the bound section is located closer to the first intersection position 55 (i.e., the case where the binding process is performed at the second binding position 8B, as shown in FIG. 9B).

In the above description, the switching between the binding process at the first binding position 8A and the binding process at the second binding position 8B is performed based on the number of sheets P constituting the sheet bundle B. Alternatively, for example, this switching may be performed based on a command from the user.

In detail, for example, if the user inputs a command for changing the binding position via an operation panel (not shown), the binding position is changed from, for example, the first binding position 8A to the second binding position 8B or from the second binding position 8B to the first binding position 8A.

For example, the number of sheets P constituting the sheet bundle B is ascertained based on information input by the user via the operation panel (not shown).

When the user inputs the information related to the number of sheets P via the operation panel (not shown), the sheet processing controller 23 (see FIG. 2) ascertains this information related to the number of sheets P. Then, based on the ascertained number of sheets P, the sheet processing controller 23 sets the binding position for the first corner 461 to the first binding position 8A or the second binding position 8B.

In this exemplary embodiment, the switching between the binding process at the first binding position 8A and the binding process at the second binding position 8B is performed by moving the sheet bundle B.

In detail, the sheet bundle B is moved by using the first movable members 81 and the second movable member 82 shown in FIG. 3, thereby changing the binding position.

In this exemplary embodiment, if the binding process is to be performed at the first binding position 8A (see FIG. 9A), the binding process is performed on the first corner 461 of the sheet bundle B in the state shown in FIG. 3.

In contrast, if the binding process is to be performed at the second binding position 8B (see FIG. 9B), the sheet processing controller 23 outputs a control signal so as to drive the movement motors M1 (see FIG. 3)

Thus, the second movable member 82 moves upward in FIG. 3, and the two first movable members 81 move leftward in FIG. 3. This causes the sheet bundle B to move in the upper left direction in FIG. 3, so that the binding position is changed to the second binding position 8B (not shown in FIG. 3).

In this exemplary embodiment, for example, the sheet processing controller 23, the movement motors M1, and the binding unit 50 function as a binding process unit. With this binding process unit, the first advancing member 512 (see FIG. 4A) and the second advancing member 522 are caused to advance toward the sheet bundle B so as to bind the sheet bundle B together. Furthermore, in this exemplary embodiment, with this binding process unit, the switching between the binding process at the first binding position 8A and the binding process at the second binding position 8B is performed.

Although the binding position is changed by moving the sheet bundle B in this exemplary embodiment, the binding position may alternatively be changed by moving the binding unit 50. As another alternative, the binding position may be changed by moving both of the sheet bundle B and the binding unit 50.

The binding unit 50 may be moved in accordance with a known technique. For example, the binding unit 50 may be moved by using a rack gear 551 that operates in conjunction with the binding unit 50, a pinion gear 552 that engages with the rack gear 551, and a pinion motor (not shown) that rotates the pinion gear 552, as indicated by a reference sign 4E in FIG. 3.

Figure 10A:
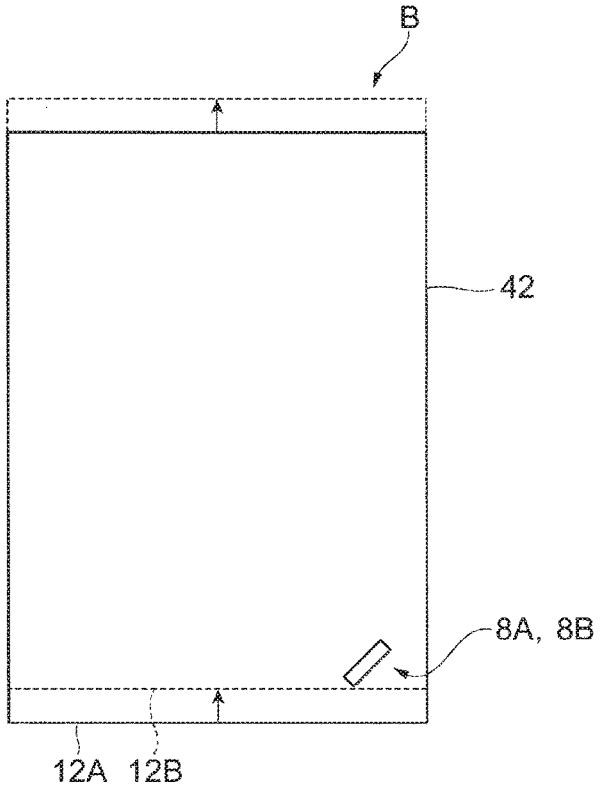
FIGS. 10A and 10B illustrate another processing example for changing the binding position.

In the above description, the binding position is changed by moving the sheet bundle B in both the direction in which the first edge 41 (see FIG. 6) extends and the direction in which the second edge 42 extends. Alternatively, for example, as shown in FIG. 10A (illustrating another processing example for changing the binding position), the binding position may be changed by moving the sheet bundle B only in the direction in which the second edge 42 extends.

In this example, when the sheet bundle B is in a state indicated by a reference sign 12A, the binding position is set to the first binding position 8A. When the sheet bundle B changes to a state indicated by a reference sign 12B as a result of the sheet bundle B moving upward in FIG. 10A, the binding position is set to the second binding position 8B.

Figure 10B:
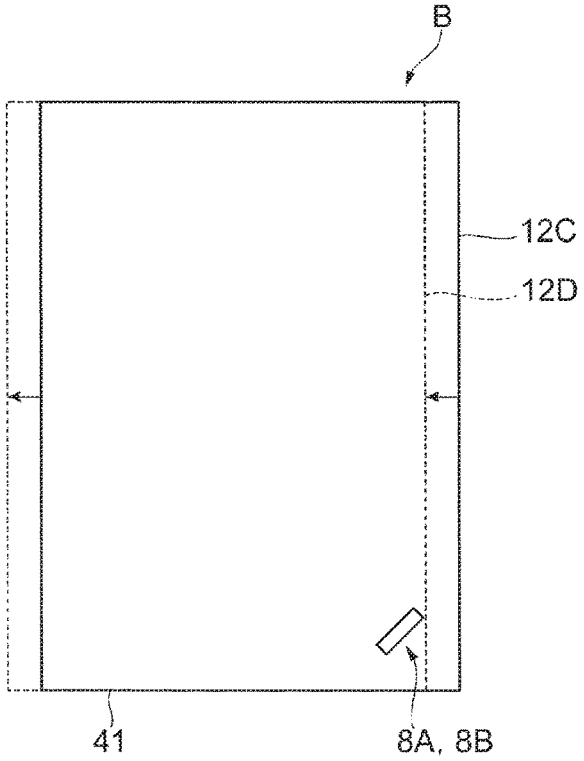

Furthermore, as shown in FIG. 10B, the binding position may be changed by moving the sheet bundle B only in the direction in which the first edge 41 extends.

In this case, when the sheet bundle B is in a state indicated by a reference sign 12C, the binding position is set to the first binding position 8A. When the sheet bundle B changes to a state indicated by a reference sign 12D as a result of the sheet bundle B moving leftward in FIG. 10B, the binding position is set to the second binding position 8B.

Although the sheet bundle B is moved in FIGS. 10A and 10B, the binding position may be changed by moving the binding unit 50 (not shown in FIGS. 10A and 10B) along one of the first edge 41 and the second edge 42.

Furthermore, the binding position may be changed by moving both of the sheet bundle B and the binding unit 50 along one of the first edge 41 and the second edge 42.

Figure 11:
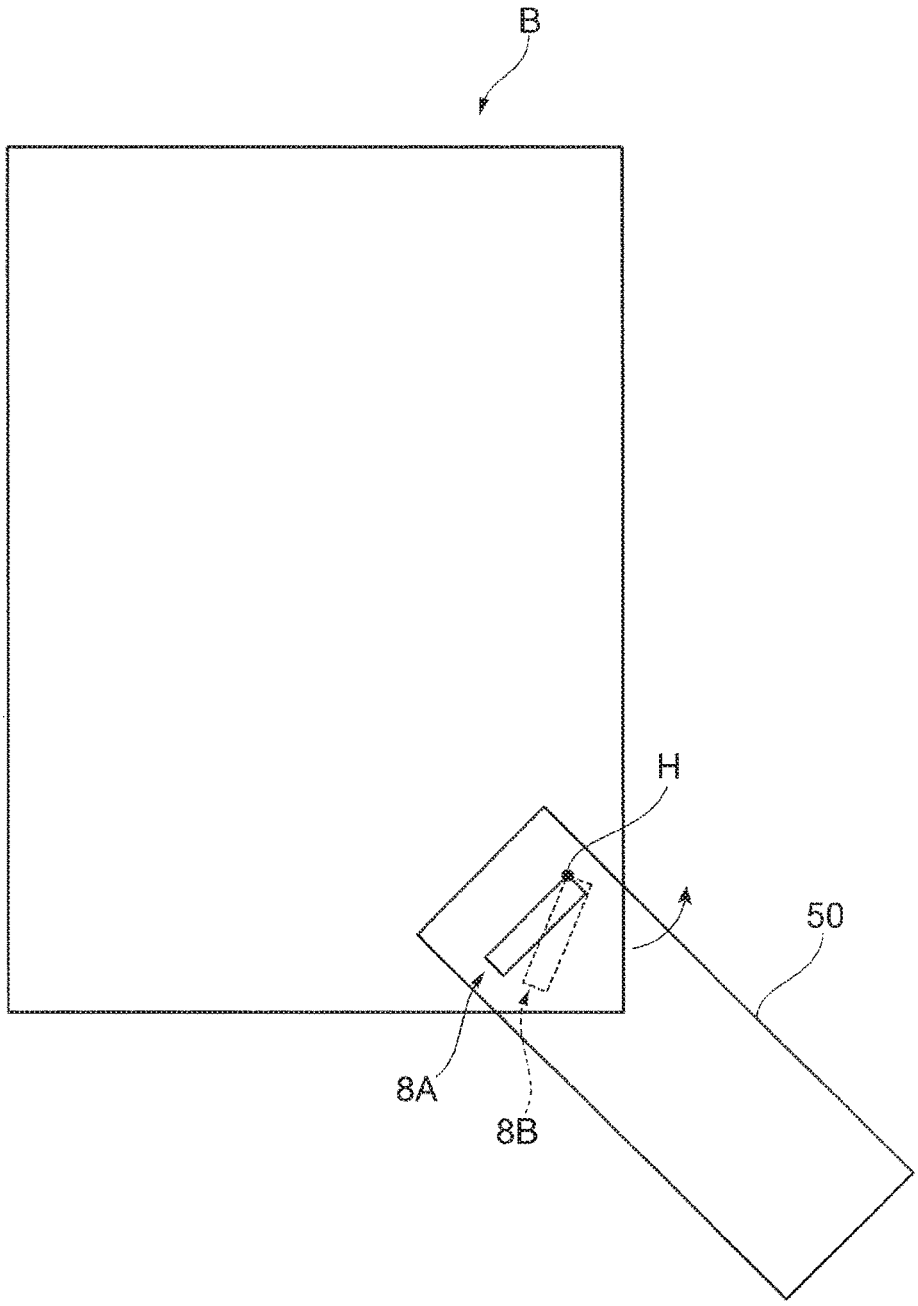
FIG. 11 illustrates another processing example for changing the binding position.

Moreover, as shown in FIG. 11 (illustrating another processing example for changing the binding position), the binding position may be changed by rotating the binding unit 50 about a predetermined rotation axis H. In other words, the switching between the binding process at the first binding position 8A and the binding process at the second binding position 8B may be performed by rotating the binding unit 50 about the predetermined rotation axis H.

As an alternative to rotating the binding unit 50, the sheet bundle B may be rotated about a predetermined rotation axis.

The binding unit 50 or the sheet bundle B may be rotated in accordance with a known technique. For example, the binding unit 50 or the sheet bundle B may be rotated by using a rotating member that rotates about a predetermined rotation axis attached to the binding unit 50 or the sheet accumulation section 60 and a rotation motor that rotates this rotating member.

Figure 12A:
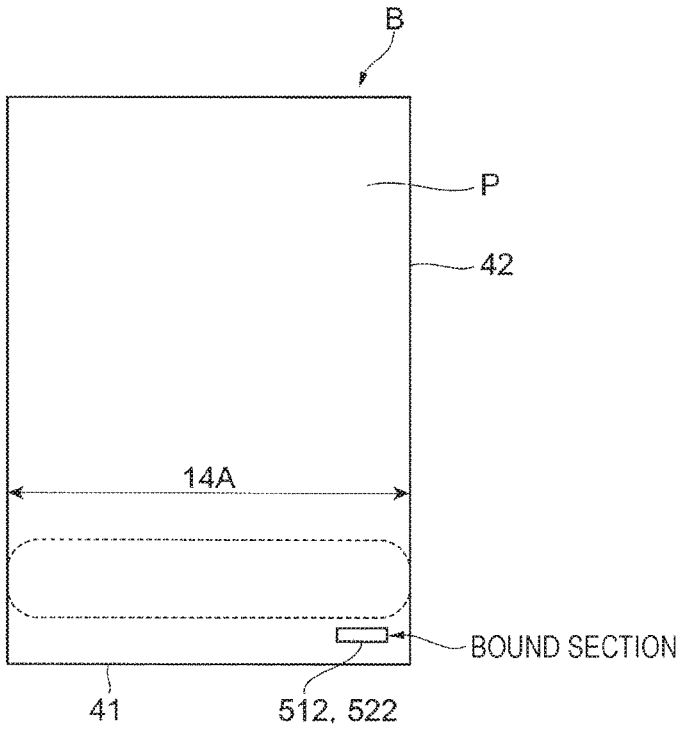
FIGS. 12A and 12B illustrate other processing examples for performing a binding process on the sheet bundle.
Figure 12B:
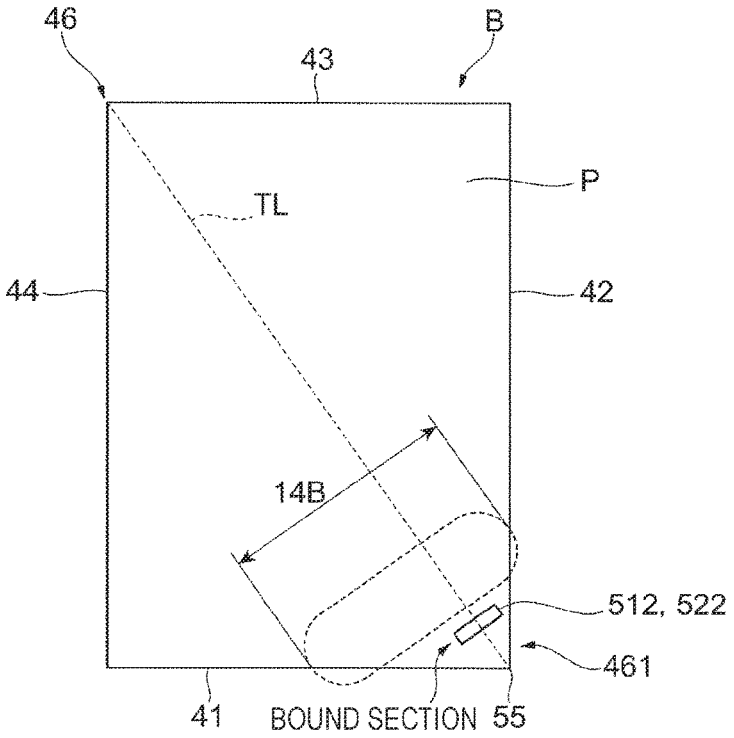

Furthermore, as shown in FIGS. 12A and 12B (illustrating other processing examples for performing the binding process on the sheet bundle B), the load acting on the bound section may be reduced by changing the orientations and the positions of the first advancing member 512 and the second advancing member 522.

In the examples shown in FIG. 12A and 12B, the binding process is performed on the sheet bundle B by causing the first advancing member 512 and the second advancing member 522 extending along the first edge 41 to advance toward the sheet bundle B, as shown in FIG. 12A. Although the first advancing member 512 and the second advancing member 522 extend along the first edge 41 in this example, the first advancing member 512 and the second advancing member 522 may alternatively extend along the second edge 42.

Furthermore, in this exemplary embodiment, the first advancing member 512 and the second advancing member 522 may extend in a direction intersecting a diagonal line TL of the sheet bundle B and may be caused to advance toward the sheet bundle B so as to bind the sheet bundle B together, as shown in FIG. 12B.

In the processing example shown in FIG. 12B, the diagonal line TL of the sheet bundle B is assumed. In detail, the assumed diagonal line TL connects the first corner 461 (i.e., one corner), which is located at the first intersection position 55 where the first edge 41 and the second edge 42 intersect, to a corner 46 located at a diagonal position with respect to the first corner 461 (i.e., the corner located at the intersection position where the third edge 43 and the fourth edge 44 intersect).

Then, in the binding process shown in FIG. 12B, the first advancing member 512 and the second advancing member 522 extending in the direction intersecting this diagonal line TL are caused to advance toward the sheet bundle B so as to bind the sheet bundle B together.

In the binding process shown in FIG. 12A, the bound section extends along the first edge 41 of the sheet bundle B so that the cosmetic appearance of the sheet bundle B may be improved. On the other hand, the area that bends when sheets P are turned over has a large dimension (i.e., dimension 14A) in the longitudinal direction, causing the load acting on the bound section to readily increase.

In contrast, in the binding process shown in FIG. 12B, the bending area has a small dimension (i.e., dimension 14B) in the longitudinal direction, so that the load acting on the bound section decreases.

Similar to the above description, the switching between the binding process shown in FIG. 12A and the binding process shown in FIG. 12B may be performed, for example, based on the number of sheets P constituting the sheet bundle B or based on a command from the user.

Furthermore, the switching between the binding process shown in FIG. 12A and the binding process shown in FIG. 12B is performed by, for example, rotating and moving the binding unit 50. Similar to the above description, the binding unit 50 is moved and rotated in accordance with a known technique.

For example, the binding unit 50 is moved and rotated by using a rotating member to which the binding unit 50 is attached, a rotation motor that rotates this rotating member, and a movement motor that linearly moves this rotating member.

Furthermore, the switching between the binding process shown in FIG. 12A and the binding process shown in FIG. 12B may alternatively be performed by rotating and moving the sheet bundle B or by rotating and moving both of the binding unit 50 and the sheet bundle B.

Other Exemplary Embodiments

In the exemplary embodiment described above, the binding position is changed by moving at least one of the sheet bundle B and the pair of advancing members (i.e., the first advancing member 512 and the second advancing member 522). Alternatively, for example, two pairs of advancing members installed at different positions from each other may be provided, and the binding position may be changed by switching between the pairs of advancing members to be used.

Furthermore, although two advancing members, namely, the first advancing member 512 and the second advancing member 522, are provided in the above description, for example, the second advancing member 522 may be eliminated and be replaced with a support base that supports the sheet bundle B from below.

Furthermore, although the binding process is performed by pressing the first advancing member 512 and the second advancing member 522 against the sheet bundle B in the above description, the binding process may be performed by using a method other than such a pressing method.

For example, at least one of or each of the first advancing member 512 and the second advancing member 522 may be provided with a cutting section. By using this cutting section, a through-hole and a flake-shaped portion to be fitted in this through-hole may be formed in the sheet bundle B. This flake-shaped portion is fitted into the through-hole. Thus, the sheets P constituting the sheet bundle B are bound together, so that a sheet bundle B in a bound state is created.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding process device comprising:

a binding process unit comprising:

an advancing member configured to advance toward a corner of a recording-medium bundle having a plurality of edges and having the corner at an intersection position where the edges intersect, wherein the binding process unit is configured to perform a binding process on the recording-medium bundle by causing the advancing member to advance toward the corner, wherein the binding process unit is configured to perform the binding process at a first position and at a second position located closer to the intersection position than the first position, wherein the binding process unit is configured to perform the binding process at the first position in response to a number of recording media constituting the recording-medium bundle being smaller than or equal to a predetermined value, wherein the binding process unit is configured to perform the binding process at the second position in response to the number of recording media constituting the recording-medium bundle exceeding the predetermined value, and wherein the binding process device is configured to switch between the binding process at the first position and the binding process at the second position by rotating at least one of the recording-medium bundle and the advancing member about a predetermined rotation axis.

2. A binding process device comprising:

a binding process unit comprising:

an advancing member configured to advance toward a corner of a recording-medium bundle having a plurality of edges and having the corner at an intersection position where the edges intersect, wherein the binding process unit is configured to perform a binding process on the recording-medium bundle by causing the advancing member to advance toward the corner, wherein the binding process unit is configured to perform the binding process at a first position and at a second position located closer to the intersection position than the first position, wherein the binding process unit is configured to perform the binding process at the first position in response to a number of recording media constituting the recording-medium bundle being smaller than or equal to a predetermined value, wherein the binding process unit is configured to perform the binding process at the second position in response to the number of recording media constituting the recording-medium bundle exceeding the predetermined value, wherein the binding process unit is configured to perform the binding process at the first position, and refrain from performing the binding process at the second position, in response to the number of recording media constituting the recording-medium bundle being smaller than or equal to the predetermined value, wherein the binding process unit is configured to perform the binding process at the second position, and refrain from performing the binding process at the first position, in response to the number of recording media exceeding the predetermined value, and wherein the first position and the second position are located such that no bound section resulting from the binding process intersects with any edges of the recoding-medium bundle.

3. A binding process device comprising:

a binding process unit comprising:

an advancing member configured to advance toward one of four corners included in a recording-medium bundle having four edges and having the corners at an intersection position where the edges intersect, wherein the binding process unit is configured to perform a binding process on the recording-medium bundle by causing the advancing member, which extends in a direction intersecting a diagonal line connecting the one corner and a corner located at a diagonal position with respect to the one corner, to advance toward the recording-medium bundle and form a first bound section extending primarily along the direction intersecting the diagonal line, wherein the binding process unit is configured to perform the binding process on the recording-medium bundle by causing the advancing member, which extends along one of the two edges intersecting at the one corner, to advance toward the recording-medium bundle and form a second bound section extending primarily along the one of the two edges, wherein the binding process unit is configured to, in response to the number of recording media constituting the recording-medium bundle being smaller than or equal to a predetermined value, perform the binding process on the recording-medium bundle by causing the advancing member extending along one of the two edges to advance toward the recording-medium bundle, and form the second bound section, wherein the binding process unit is configured to, in response to the number of recording media constituting the recording-medium bundle exceeding the predetermined value, perform the binding process on the recording-medium bundle by causing the advancing member extending in the direction intersecting the diagonal line to advance toward the recording-medium, and form the first bound section, wherein the binding process unit is configured to, in response to the number of recording media constituting the recording-medium bundle being smaller than or equal to the predetermined value, perform the binding process on the recording-medium bundle by causing the advancing member extending along the one of the two edges to advance toward the recording-medium bundle, form the second bound section, and refrain from forming the first bound section, and wherein the binding process unit is configured to, in response to the number of recording media exceeding the predetermined value, perform the binding process on the recording-medium bundle by causing the advancing member extending in the direction intersecting the diagonal line to advance toward the recording-medium bundle, from the first bound section, and refrain from forming the second bound section.

4. The binding process device according to claim 3, wherein the first bound section does not intersect with any edges of the recoding-medium bundle, and wherein the second bound section does not intersect with any edges of the recoding-medium bundle.

* * * * *